US009951765B2

(12) United States Patent
Ki et al.

(10) Patent No.: US 9,951,765 B2
(45) Date of Patent: Apr. 24, 2018

(54) LINEAR COMPRESSOR, SHELL FOR LINEAR COMPRESSOR, AND METHOD FOR MANUFACTURING SHELL OF LINEAR COMPRESSOR

(71) Applicant: LG ELECTRONICS INC., Seoul (KR)

(72) Inventors: Sunghyun Ki, Seoul (KR); Kyeongbae Park, Seoul (KR); Wonhyun Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 323 days.

(21) Appl. No.: 14/661,099

(22) Filed: Mar. 18, 2015

(65) Prior Publication Data

US 2015/0377228 A1 Dec. 31, 2015

(30) Foreign Application Priority Data

Jun. 25, 2014 (KR) ..... 10-2014-0078059

(51) Int. Cl.
*F04B 39/12* (2006.01)
*F04B 37/00* (2006.01)
(Continued)

(52) U.S. Cl.
CPC ..... *F04B 39/121* (2013.01); *F04B 35/045* (2013.01); *F04B 37/00* (2013.01);
(Continued)

(58) Field of Classification Search
CPC .... F04B 35/045; F04B 37/00; F04B 39/0016; F04B 39/0033; F04B 39/0088; F04B 39/121; G10K 11/16; G10K 11/00
(Continued)

(56) References Cited

U.S. PATENT DOCUMENTS 1,895,806 A * 1/1933 Lipman ..... F25D 23/003 62/296
2,808,122 A * 10/1957 Meyers ..... B64F 1/26 181/204
(Continued)

FOREIGN PATENT DOCUMENTS

CN 102197222 9/2011
CN 102261350 11/2011
(Continued)

OTHER PUBLICATIONS

Chinese Office Action dated Jan. 13, 2017 (English Translation).
(Continued)

*Primary Examiner* — Dominick L Plakkoottam
*Assistant Examiner* — Benjamin Doyle
(74) *Attorney, Agent, or Firm* — KED & Associates, LLP

(57) ABSTRACT

A linear compressor, a shell for a linear compressor, and a method for manufacturing a shell of a linear compressor are provided. The shell may have at least one portion having a multilayer plate, in which at least two plates may be stacked in a direction substantially perpendicular to an axis of a piston so as to accommodate a cylinder, the piston, which may be reciprocated within the cylinder, and a motor assembly directly connected to the piston to provide a drive force to the piston. At least one resonator may be disposed in or at at least a portion of an inner surface of the shell.

8 Claims, 7 Drawing Sheets

(51) Int. Cl.
*F04B 39/00* (2006.01)
*F04B 35/04* (2006.01)
*G10K 11/16* (2006.01)

(52) U.S. Cl.
CPC ..... *F04B 39/0016* (2013.01); *F04B 39/0033* (2013.01); *F04B 39/0088* (2013.01); *G10K 11/16* (2013.01)

(58) Field of Classification Search
USPC ..... 417/417, 312, 902, 415, 45, 212, 313, 417/363, 372, 420, 53, 545; 181/403, 181/198, 200
See application file for complete search history.

(56) References Cited

U.S. PATENT DOCUMENTS 3,905,204 A * 9/1975 Edwards ..... F04C 29/12 181/224
3,905,443 A 9/1975 Sieuzac
4,347,043 A * 8/1982 Morris ..... F04B 39/0033 181/202
4,435,877 A * 3/1984 Berfield ..... A47L 9/0081 15/326
4,982,812 A * 1/1991 Hwang ..... F04B 39/0033 181/202
4,991,406 A * 2/1991 Fujii ..... F24F 1/56 62/259.1
5,041,323 A * 8/1991 Rose ..... B32B 3/12 181/292
5,272,285 A * 12/1993 Miller ..... F04B 39/0033 181/202
5,588,810 A * 12/1996 DiFlora ..... F04B 39/0033 181/202
5,772,410 A * 6/1998 Chang ..... F04B 35/045 417/363
5,981,046 A * 11/1999 Masui ..... B29C 44/025 428/213
5,997,258 A * 12/1999 Sawyer ..... F04B 39/0033 181/202
6,062,033 A * 5/2000 Choi ..... F04B 39/0033 417/312
6,182,787 B1 * 2/2001 Kraft ..... F02C 7/045 181/292
6,604,603 B1 * 8/2003 Wirth ..... F16L 59/024 181/200
6,720,069 B1 * 4/2004 Murakami ..... G10K 11/16 428/131
6,872,057 B2 * 3/2005 Kim ..... F04B 39/0027 181/202
7,244,489 B2 * 7/2007 Owensby ..... A47L 13/16 428/310.5
7,357,219 B2 * 4/2008 Mafi ..... F24F 1/12 181/200
7,398,855 B2 * 7/2008 Seel ..... F01C 21/10 181/200
8,312,562 B2 * 11/2012 Hammons ..... A41D 19/01523 2/16
8,418,806 B1 * 4/2013 Wyerman ..... G10K 11/002 181/284
8,820,477 B1 * 9/2014 Herrera ..... F02C 7/045 181/284
8,950,208 B2 * 2/2015 Bae ..... F24F 1/08 62/295
8,951,623 B2 * 2/2015 Hoetzeldt ..... B32B 5/26 181/292
8,967,324 B2 * 3/2015 White ..... F04B 23/10 181/200
9,153,225 B2 * 10/2015 Bonifas ..... G10K 11/16
9,234,499 B2 * 1/2016 Appleton ..... F03D 1/065
9,486,975 B2 * 11/2016 Franzoi ..... F02C 7/045
9,514,734 B1 * 12/2016 Jones ..... G10K 11/172
9,604,438 B2 * 3/2017 Lumbab ..... B32B 37/12
2004/0052659 A1 * 3/2004 Kim ..... F04B 39/0027 417/363
2006/0210859 A1 9/2006 Choi et al.
2009/0232666 A1 * 9/2009 Choi ..... F04B 35/045 417/212
2011/0058968 A1 * 3/2011 Kang ..... F04B 17/04 417/415
2011/0250083 A1 * 10/2011 Park ..... F04B 39/122 417/420
2012/0024148 A1 * 2/2012 Kang ..... F04B 35/045 92/161
2012/0167608 A1 * 7/2012 Bae ..... F24F 1/08 62/296
2012/0230842 A1 * 9/2012 Hu ..... F04B 35/045 417/45
2013/0004335 A1 * 1/2013 Hu ..... F04B 35/045 417/45
2013/0082194 A1 * 4/2013 Muto ..... H01J 37/28 250/492.3
2013/0129540 A1 * 5/2013 Song ..... F04B 35/045 417/415
2015/0377228 A1 * 12/2015 Ki ..... F04B 35/045 417/545

FOREIGN PATENT DOCUMENTS

| | | |
|---|---|---|
| CN | 203335414 | 12/2013 |
| EP | 1 020 846 | 7/2000 |
| EP | 1 596 067 | 11/2005 |
| JP | 3-189387 | 8/1991 |
| JP | 2001-184076 | 7/2001 |
| JP | 2003-120531 | 4/2003 |
| JP | 2009-156141 | 7/2009 |

OTHER PUBLICATIONS

European Search Report dated Oct. 30, 2015.
Chinese Office Action (with English Translation) dated Sep. 22, 2017 issued in Application No. 201510266212.9.

* cited by examiner

LINEAR COMPRESSOR, SHELL FOR LINEAR COMPRESSOR, AND METHOD FOR MANUFACTURING SHELL OF LINEAR COMPRESSOR

CROSS-REFERENCE TO RELATED APPLICATION(S)

This application claims priority under 35 U.S.C. § 119 to Korean Application No. 10-2014-0078059, filed in Korea on Jun. 25 , 2014, whose entire disclosure is hereby incorporated by reference.

BACKGROUND

1. Field

A linear compressor, a shell for a linear compressor, and a method for manufacturing a shell of a linear compressor are disclosed herein.

2. Background

Compressors are machines that receive power from a power generation device, such as an electric motor or turbine, to compress air, a refrigerant, or various working gases, thereby increasing in pressure. Compressors are being widely used in home appliances, such as refrigerators or air conditioners, or in industrial fields.

Compressors may be largely classified into reciprocating compressors, in which a compression space into and from which a working gas, such as a refrigerant, is suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress a refrigerant while the orbiting scroll rotates along the fixed scroll. In recent years, a linear compressor, which is directly connected to a drive motor and in which a piston is linearly reciprocated, to improve compression efficiency without mechanical losses due to movement conversion and having a simple structure, is being widely used. The linear compressor may suction in and compress a working gas, such as a refrigerant, while a piston is linearly reciprocated in a sealed shell by a linear motor and then discharge the refrigerant.

Noise may occur in the linear compressor. More particularly, vibration noise and airborne noise may occur due to a reciprocating motion of the piston used in the linear compressor, mechanical vibration and collision of other components, and refrigerant flow. The mechanical vibration may be transmitted into components forming a refrigeration cycle, such as an evaporator and a condenser, along a tube connected to the linear compressor, causing resonance, thereby making loud noise. The noise may cause inconvenience to a user of electronic equipment employing the linear compressor.

As the noise causes inconvenience to the user, it is estimated as a major factor for determining quality of a linear compressor. The linear compressors may vary in price according to a noise degree. For example, if noise of a linear compressor is reduced by about 1 dB, the linear compressor may rise in price by one dollar. In premium products, noise reduction in the linear compressor is a matter for a person in charge of R&D.

As drive frequency increases, the noise may increase. That is, the noise may increase in proportion to a square of velocity increment of a noise source. For example, if the drive frequency increases from about 60 Hz to about 120 Hz, the noise may increase by about 6 dB or more. The noise may increase over a whole noise frequency region.

For equipment, such as a refrigerator, in which the linear compressor is installed, there is a great need to increase a capacity of the refrigerator by reducing a volume of a machine room. Due to this trend, miniaturization of linear compressors is quickly progressing. As a result, the drive frequency of the linear compressor increases due to the miniaturization of the linear compressor. Thus, there is a requirement to reduce noise.

To reduce noise of the linear compressor according to the related art, a vibration absorber is used in a tube. However, even though the vibration absorber is applied to a high speed drive frequency of about 100 Hz or more, it may be difficult to sufficiently reduce the noise.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described in detail with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
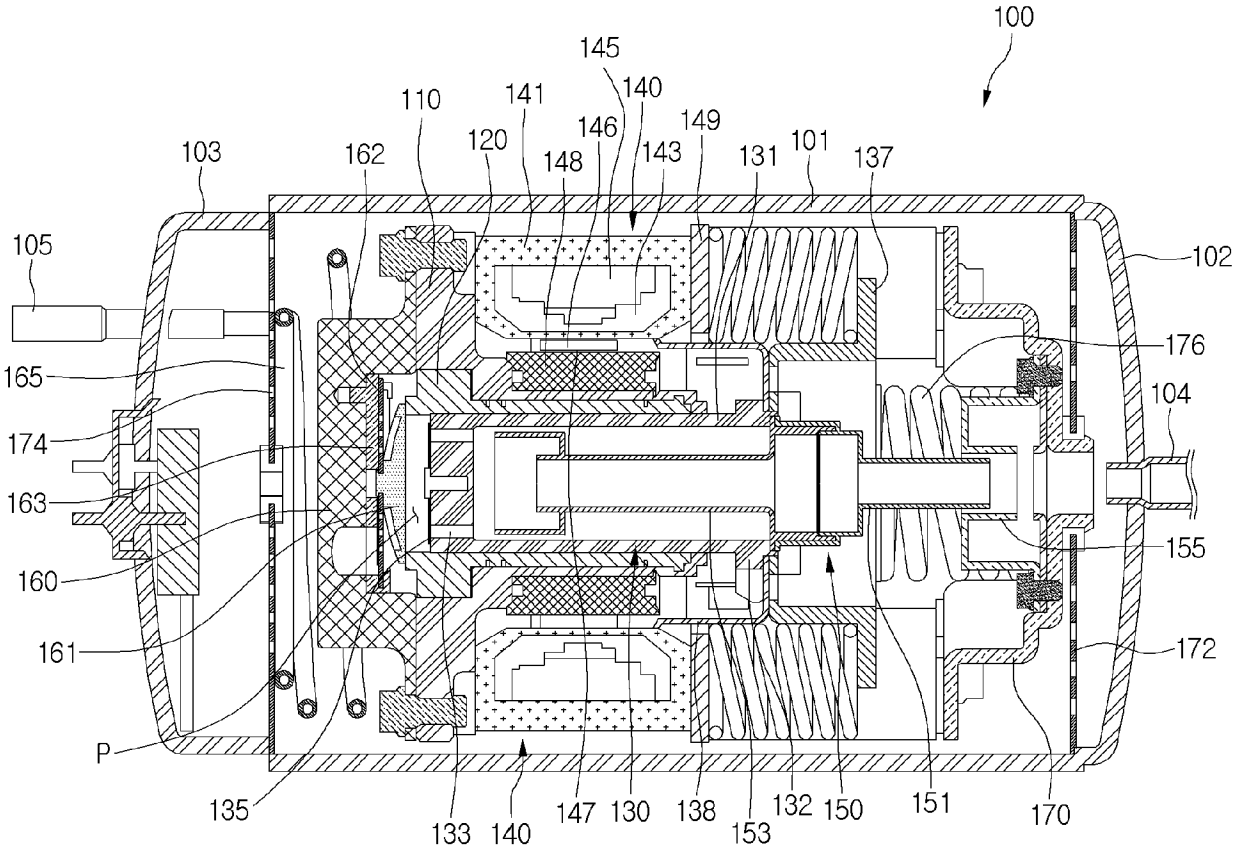
FIG. 1 is a cross-sectional view of a linear compressor according to an embodiment.

FIG. 1 is a cross-sectional view of a linear compressor according to an embodiment. Referring to FIG. 1, the linear compressor 100 according to an embodiment may include a cylindrical shell 101, a first cover 102 coupled to a first side of the shell 101, and a second cover 103 coupled to a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101.

As the shell 101 may be manufactured in the cylindrical shape, if the shell 101 is installed in electronic equipment, such as a refrigerator, the shell 101 may be sufficiently installed in an inner space of a machine room. As the shell 101 is manufactured in a laid out state, the shell 101 may be disposed with a compact structure within the machine room of the electronic equipment. Thus, a usage space of components in the electronic equipment may increase, and thus, the electronic equipment itself may be reduced in size. Also, in the electronic equipment, an available volume utilized as a low-temperature space may increase. However, as the shell 101 manufactured in the cylindrical shape has a characteristic in which the cylindrical shell 101 is vulnerable to noise when compared to a globular shape according to the related art, there is a need to address this issue.

First, a linear compressor according to an embodiment will be described in detail hereinbelow.

The linear compressor 100 may include a cylinder 120 provided in the shell 101, a piston 130 linearly reciprocated within the cylinder 120, and a motor assembly 140 that serves as a linear motor to apply a drive force to the piston 130. The linear compressor 100 may further include a suction inlet 104, through which a refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. Thus, while the refrigerant passes through the suction muffler 150, noise may be reduced. The suction muffler 150 may include a first muffler 151 coupled to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a non-magnetic material, such as an aluminum material, such as aluminum or an aluminum alloy. As the piston 130 may be formed of the aluminum material, a magnetic flux generated in the motor assembly 140 may not be transmitted into the piston 130, and thus, may be prevented from leaking outside of the piston 130. The piston 130 may be manufactured by a forging process, for example.

The cylinder 120 may be formed of a non-magnetic material, such as an aluminum material, such as aluminum or an aluminum alloy. The cylinder 120 and the piston 130 may have a same material composition, that is, a same kind of material and composition. As the cylinder 120 may be formed of the aluminum material, a magnetic flux generated in the motor assembly 200 may not be transmitted into the cylinder 120, and thus, may be prevented from leaking outside of the cylinder 120. The cylinder 120 may be manufactured by an extruding rod processing, for example.

As the piston 130 may be formed of the same material as the cylinder 120, the piston 130 may have a same thermal expansion coefficient as the cylinder 120. When the linear compressor 100 operates, a high-temperature (a temperature of about 100° C.) environment may be created within the shell 100. Thus, as the piston 130 and the cylinder 120 may have the same thermal expansion coefficient, the piston 130 and the cylinder 120 may be thermally deformed by a same degree. As a result, the piston 130 and the cylinder 120 may be thermally deformed by the same degree with sizes and in directions different from each other to prevent the piston 130 from interfering with the cylinder 120 while the piston 130 moves.

The cylinder 120 may be configured to accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P and a discharge valve assembly 161, 162, and 163 coupled to the discharge cover 160 to selectively discharge the refrigerant compressed in the compression space P may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 to restrict deformation of the valve spring 162.

The term "compression space P" may refer to a space defined between the suction valve 135 and the discharge valve 161. The term "axial direction" may refer to a direction in which the piston 130 is reciprocated, that is, a transverse direction in FIG. 1. Also, in the axial direction, a direction from the suction inlet 104 toward the discharge outlet 105, that is, a direction in which the refrigerant flows, may be referred to as a "frontward direction", and a direction opposite to the frontward direction may be referred to as a "rearward direction". On the other hand, the term "radial direction" may refer to a direction perpendicular to the direction in which the piston 130 is reciprocated, that is, a vertical direction in FIG. 1.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

The suction valve 135 may be disposed on or at a first side of the compression space P, and the discharge valve 161 may be disposed on or at a second side of the compression space P, that is, a side opposite of the suction valve 135. While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the suction valve 135 may compress the refrigerant of the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape which is wound in a predetermined direction and extends in a rounded shape. The loop pipe 165 may be coupled to the discharge outlet 105.

The linear compressor 100 may further include a frame 110. The frame 110 may fix the cylinder 120 and be coupled to the cylinder 120 by a separate coupling member, for example. The frame 110 may be disposed to surround the cylinder 120. That is, the cylinder 120 may be accommodated within the frame 110. The discharge cover 172 may be coupled to a front side of the frame 110.

At least a portion of the high-pressure gaseous refrigerant discharged through the open discharge valve 161 may flow toward an outer circumferential surface of the cylinder 120 through a space formed at a portion at which the cylinder 120 and the frame 110 are coupled to each other. The refrigerant introduced to an outside of the cylinder 120 may flow into a space between the piston 130 and the cylinder 120 to allow an outer circumferential surface of the piston 130 to be spaced from an inner circumferential surface of the cylinder 120. Thus, the introduced refrigerant may serve as a "gas bearing" that reduces friction between the piston 130 and the cylinder 120 while the piston 130 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be a single magnet having one polarity, or may include a plurality of magnets having three polarities.

The permanent magnet 146 may be coupled to the piston 130 by a connection member 138. In detail, the connection member 138 may be coupled to the piston flange 132 and be bent to extend toward the permanent 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may surround an inside and an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 145. The coil 145 may have a polygonal cross-section, for example, a hexagonal cross-section. The stator core 141 may be manufactured by stacking a plurality of laminations in the circumferential direction and be disposed to surround the coil winding bodies 143 and 145.

A stator cover 149 may be disposed on or at one side of the outer stators 141, 143, and 145. A first side of the outer stators 141, 143, and 145 may be supported by the frame 110, and a second side of the outer stators 141, 143, and 145 may be supported by the stator cover 149. The inner stator 148 may be fixed to a circumference of the cylinder 120. In the inner stator 148, the plurality of laminations may be stacked in a circumferential direction outside of the cylinder 120.

The linear compressor 100 may further include a support 137 to support the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned in through the suction outlet 104 to introduce the refrigerant into the suction muffler 150.

The linear compressor 100 may further include a plurality of springs 176 which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may additionally includes plate springs 172 and 174, respectively, disposed on lateral sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Noise may occur due to a plurality of factors during operation of the linear compressor. For example, exemplary examples of such noise include knocking sounds that occur during opening/closing operations of the suction valve 135 and the discharge valve 161, and vibration occurring due to abnormal sounds, flow noise due to compression and expansion of the refrigerant, contact noise due to relative motion between components, and vibration noise. As described above, these noises may increase in proportion to a square of an increasing drive frequency of the linear compressor.

The noise generated in the linear compressor may be generally classified as follows. The noise generated in the linear compressor may be divided into vibration noise generated mainly due to contact between components and mainly transmitted along structure, and airborne noise generated due to various factors, such as pressure variation, knocking sounds and transmitted fluid.

Figure 2:
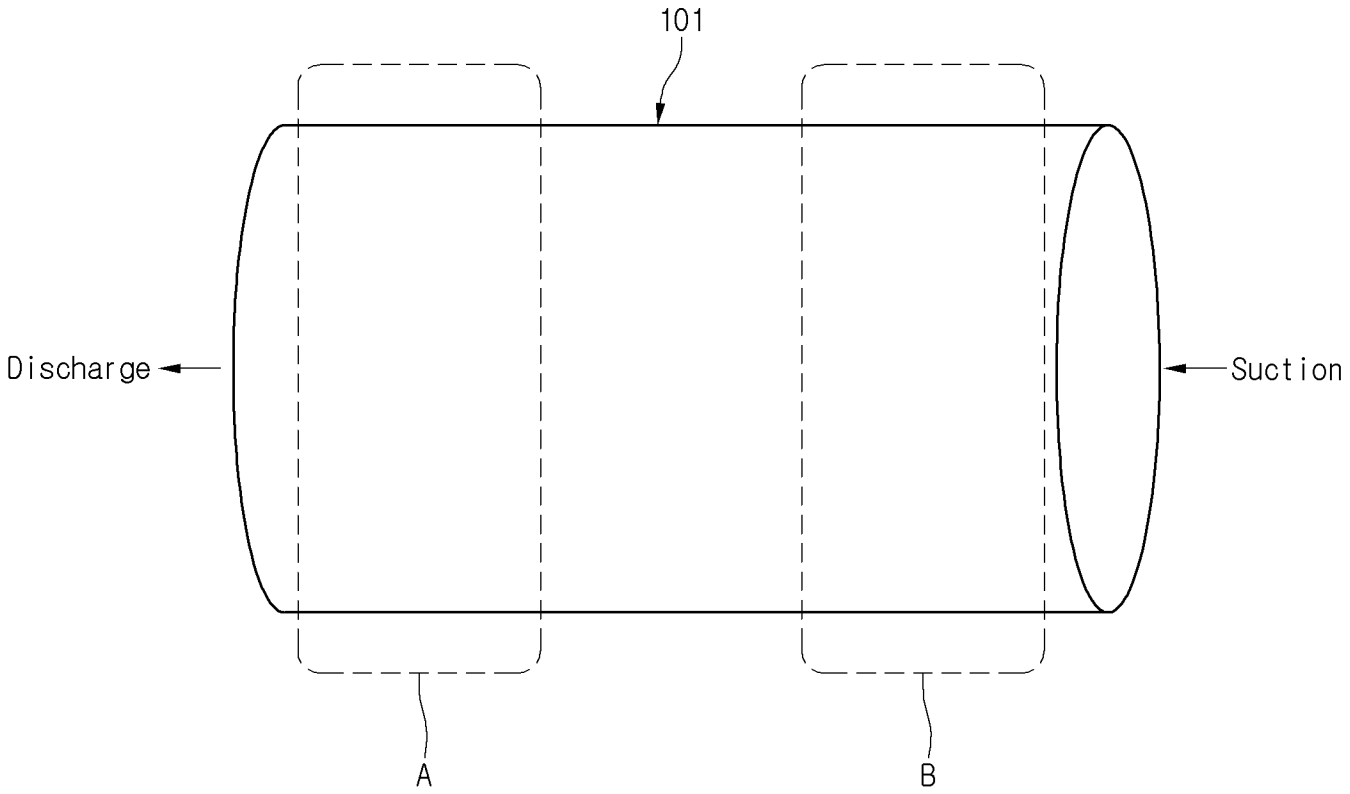
FIG. 2 is a view illustrating a noise trend depending on a position along the linear compressor.

FIG. 2 is a view illustrating a noise trend depending on a position of the linear compressor. Referring to FIG. 2, vibration noise tends to be mainly concentrated at a discharge-side A of the linear compressor in a high-frequency band of about 2 KHz or more. Airborne noise tends to be mainly concentrated at a suction-side B of the linear compressor in a low-frequency band of about 2 KHz or less. To effectively remove the vibration noise and the airborne noise, the shell 101 having a cylindrical shape may have a specific structure.

Figure 3:
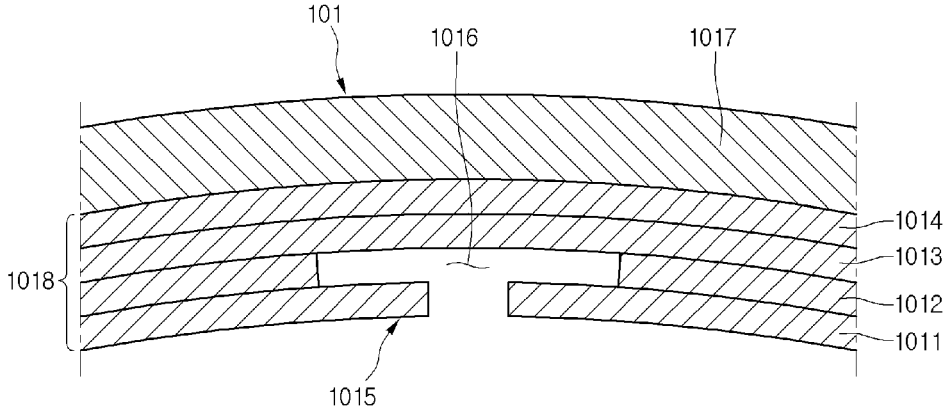
FIG. 3 is a partial enlarged cross-sectional view illustrating a shell of a linear compressor according to an embodiment.

FIG. 3 is a partial enlarged cross-sectional view illustrating a shell of the linear compressor according to an embodiment. Referring to FIG. 3, the shell 101 may include a container 1017, and a multilayer plate 1018 provided in the container 1017. A resonator 1015 may be provided on or at an inner surface of the shell 101. The resonator 1015 may be in the form of a recess provided on or at an inner surface of the shell 101. The recess may include an expansion space 1016. The expansion space 1016 may be a predetermined space provided in the resonator 1015. The resonator 1015 may be used to detect sound having at least one specific frequency using a resonant phenomenon. In this embodiment, the resonator 1015 may have a feature in that it is capable of reducing noise having at least one specific frequency band. That is, when airborne noise occurs, sound having a specific frequency may enter into the resonator 1015 and then expand within the expansion space 1016 to interfere with each other, thereby reducing the noise. Also, an inside of the shell 101 may have a structure in which a plurality of plates 1011, 1012, 1013, and 1014 are stacked, that is, a multilayer plate structure 1018. Thus, at least portions of the stacked plates may be spaced apart from each other to relatively move with respect to each other, thereby reducing vibration noise. For example, the stacked plates may behave differently with respect to each other. Thus, the vibration noise transmitted into one plate may not be transmitted into the other plate or interfere with the other plates to offset the vibration noise.

The shell 101 will be described in more detail hereinbelow.

The container 1017 may be manufactured in an integrated cylindrical shape to form an empty space. The multilayer plate 1018 may be manufactured by stacking plates on each other. For example, the multilayer plate 1018 may be manufactured by rolling a plate formed of a stainless material or manufactured by inserting and coupling cylinders having different diameters with respect to each other. In the final process for manufacturing the multilayer plate 1018, the multilayer plate 1018 may be firmly manufactured using, for example, welding, rivet, or bolt coupling. The container 1017 and the multilayer plate 1018 may be coupled to each other to complete the shell 101.

The multilayer plate 1018 may include four plates, that is, a first layer plate 1011, a second layer plate 1012, a third layer plate 1013, and a fourth layer plate 1014, which may be arranged in order outward. A recess defined in the first layer plate 1011, and a recess defined in the second layer plate 1012 may be aligned to provide or form the resonator 1015. The recess defined in the layer plate 1012 may have a size greater than a size of the recess defined in the first layer plate 1011 to provide or form the expansion space 1016.

The resonator 1015 may be recesses provided in the first and second layer plates 1011 and 1012 to reduce the airborne noise. In addition, an inner surface of the shell 101 may have the structure of the plurality of stacked plates, to reduce the vibration noise.

Figure 4:
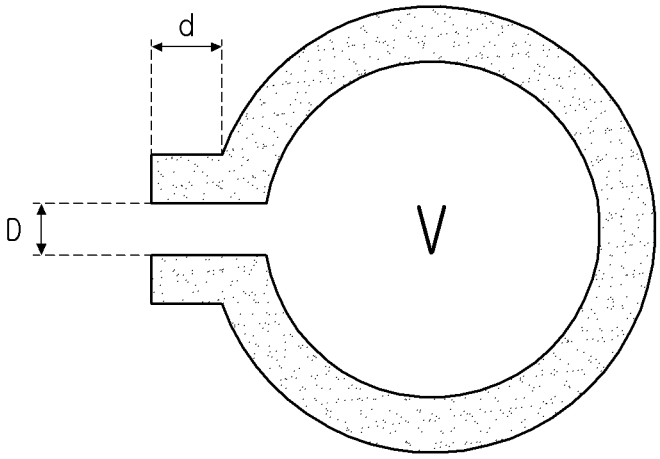
FIG. 4 is a reference view for explaining selection of a frequency reduced by a resonator.

FIG. 4 is a reference view for explaining selection of a frequency reduced by a resonator. Referring to FIG. 4, when an inlet cross-section area of the resonator is A, a length of an inlet is d, and a volume of the inner expansion space of the resonator is V, a reduced frequency $f_0$ may be expressed using the following Equation 1:

$$f_0 = 60\sqrt{\frac{A}{d}\cdot\frac{1}{v}} \quad \text{[Equation 1]}$$

According to Equation 1, it is seen that the volume V of the expansion space, the inlet cross-section area A, the inlet length d may be adjusted to selectively reduce noise having various frequencies. A noise having a different frequency band as well as the selected specific frequency may be reduced according to various other factors, such as an inner structure of the expansion structure, an inlet position, and a harmonic wave characteristic. However, it may be predictable when the frequency reduction effect with respect to the selected specific frequency is largest.

The frequency reduction characteristic based on testing will be described hereinbelow.

The linear compressor may operate at a frequency of about 120 Hz, and the shell 101 may include the container 1017, that is, the cylindrical shell, and the multilayer plate 1018. If each of the plates forming the multilayer plate 1018 has a thickness of about 0.5 mm, the recess of the first layer plate 1011 has a diameter of about 0.8 mm, and the recess of the second layer plate 1012 is processed half and half at diameters of about 9.0 mm and about 4 mm, it is seen that reduced frequency bands are at about 5.3 KHz and about 12 KHz, respectively, in FIGS. 5 and 6.

The results of the testing will be described in more detail hereinbelow.

The testing was performed by comparing a case A, in which only the single-layered cylindrical shell according to the related art is used, a case B, in which the container 1017, that is, the cylindrical shell, and the multilayer plate 1018 are provided together, and a case C, in which the container 1017, that is, the cylindrical shell and the multilayer plate 1018 are provided together, and also, the resonator and the expansion space are provided in the multilayer plate. The linear compressor may have a drive frequency of about 120 Hz, and each of the plates of the multilayer plate may have a thickness of about 0.5 mm. Further, when the resonator and the expansion space are provided in the multilayer plate, the recess of the first layer plate 1011 may have a diameter of about 0.8 mm, and the recess of the second layer plate may be processed half and half at a diameter of about 9.0 mm and about 4 mm, respectively.

Figure 5:
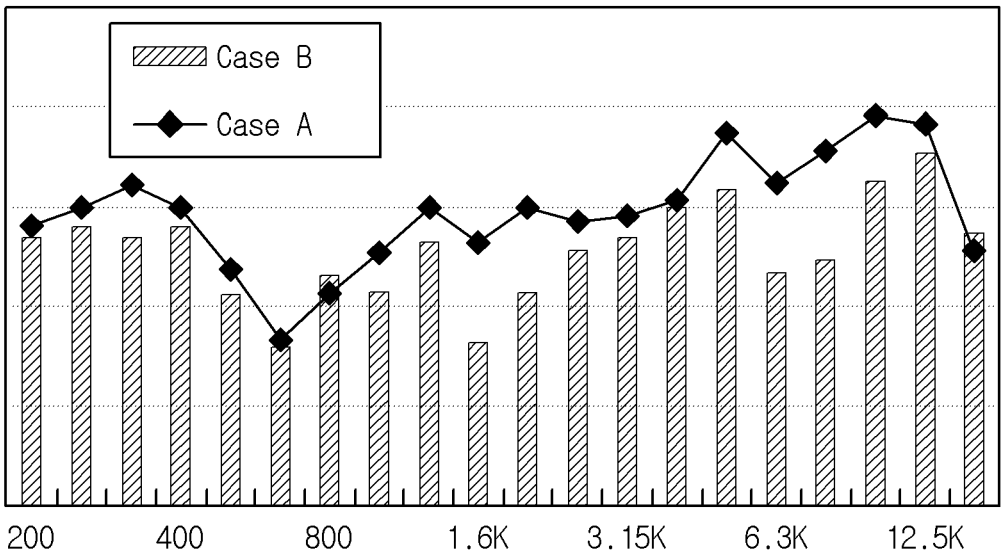
FIG. 5 is a graph comparing a case A to a case B.
Figure 6:
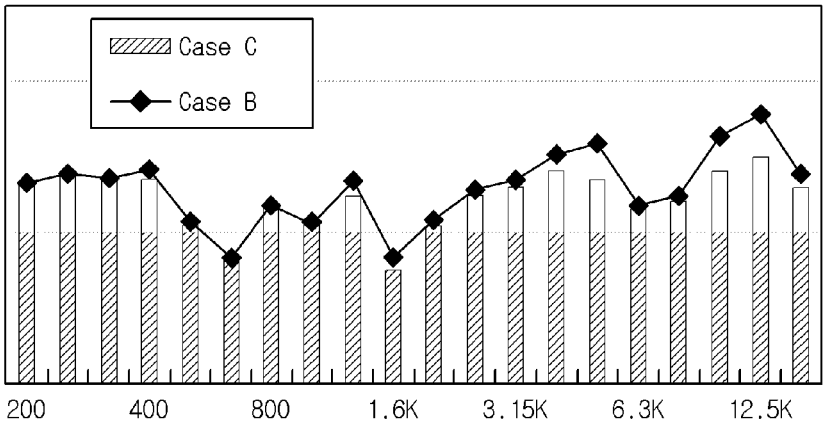
FIG. 6 is a graph comparing a case B to a case C.

FIG. 5 is a graph comparing case A to case B. FIG. 6 is a graph comparing case B to case C.

Referring to FIG. 5, when the multilayer plate is used, it is seen that the noise is reduced in various frequency bands. Further, it is seen that the vibration noise is significantly reduced in the high-frequency band of about 2 KHz or more. That is, it is seen that the various vibration noise generated due to machine noise is reduced. Referring to FIG. 6, it is seen that noise is reduced in frequency bands of about 5.3 KHz and about 12 KHz when the resonator and the expansion space are provided. Also, it is seen that the noise is reduced in a frequency band of about 2 KHz or less, in which the airborne noise is stronger, for example, frequency bands of about 1.6 KHz and about 400 Hz. Thus, it is seen that the airborne noise is capable of being sufficiently reduced in the resonator 1015 and the expansion space 1016. Further, when the resonator is variously changed in shape using frequency selectivity thereof, it is seen that the vibration noise and the airborne noise, which have various frequencies, may be reduced according to noise characteristics of the linear compressor.

As described with reference to FIG. 2, in the shell 101 of the linear compressor, the airborne noise having low frequencies of about 2 KHz or less are stronger at the suction-side of the shell 101. Thus, the resonator 1015 and the expansion space 1016 may be provided only at the suction-side of the shell 101, and not at the discharge-side of the shell 101. Also, the resonator 1015 and the expansion space 1016 may be provided in sizes, shapes, and structures different from each other in an axial direction of the shell in accordance with the frequency characteristics of the noise for each position of the shell to vary in characteristic of noise reduction for each position. Also, vibration noise having high frequencies of about 2 KHz or more may be stronger at the discharge-side of the shell. Thus, if the shell having the multilayer plate is difficult to manufacture or is expensive, the shell having the multilayer plate may be provided only at the discharge-side without being provided at the other portion, or the multilayer plate may be changed in stacked number.

As described above, as the multilayer plate, the resonator, and the expansion space may be changed in configuration, size, and number according to a relative position of the vibration noise and a relative position of the airborne noise in the shell, noise reduction of the linear compressor which operates at a high frequency may be optimized. In particular, although the airborne noise transmitted into a fluid does not have a large influence when compared to the vibration noise, the airborne noise is not ignorable in a premium linear compressor. Thus, according to this embodiment, the noise reduction effect of the premium linear compressor may be further improved.

Figure 7:
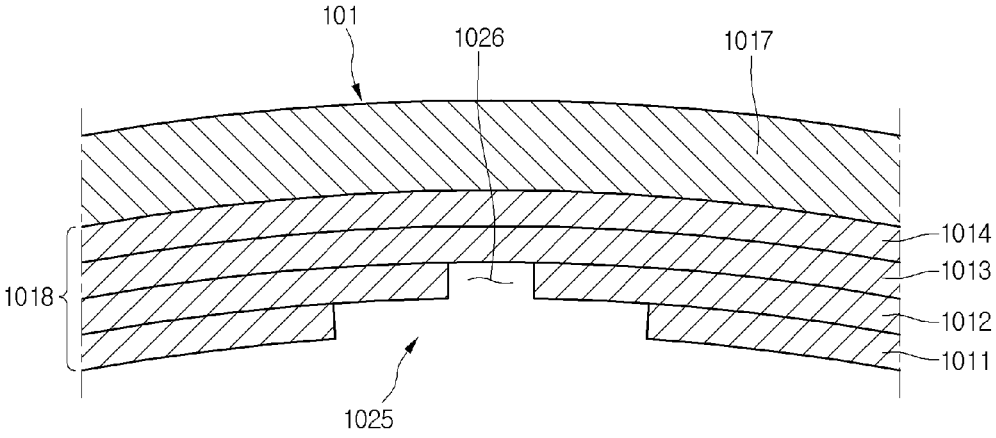
FIG. 7 is a partial cross-sectional view of a shell according to another embodiment.

FIG. 7 is a partial cross-sectional view of a shell according to another embodiment. Referring to FIG. 7, in resonator 1025, a recess of first layer plate 1011 may be greater than a recess of second layer plate 1012. In this case, referring to Equation 1, the resonator 1025 may increase in inlet cross-section area, and the expansion space 1026 may decrease in volume to reduce the airborne noise having higher frequencies. On the other hand, when the inlet cross-section area decreases, and the internal volume increases, the airborne noise having lower frequencies may be reduced. Also, a length of a neck of an inlet may be elongated to reduce the airborne noise having lower frequencies. A method for elongating the neck of the inlet part may include a method in which the first layer plate 1011 and the second layer plate 1012 are provided at the inlet, and the expansion space 1026 is provided in a third layer plate 1013.

Figure 8:
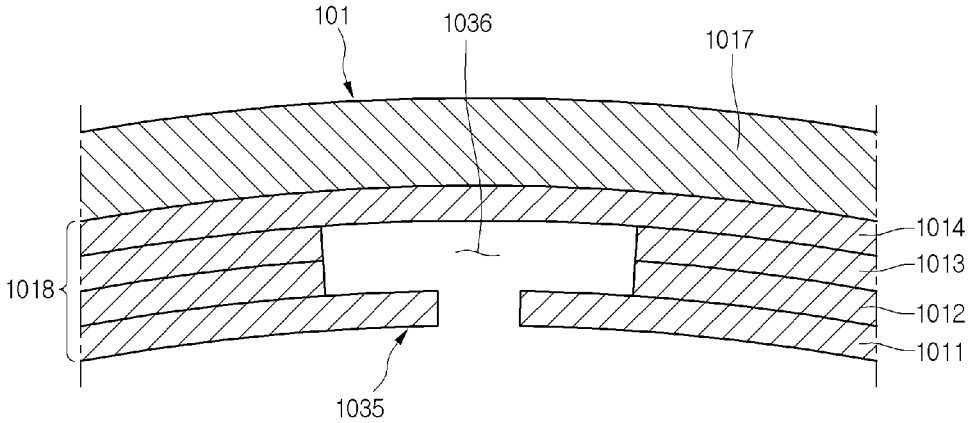
FIG. 8 is a partial cross-sectional view of a shell according to another embodiment.

FIG. 8 is a partial cross-sectional view of a shell according to another embodiment. Referring to FIG. 8, in resonator 1035, first layer plate 1011 may have a same recess as the first embodiment, and second and third layer plates 1012 and 1013 may form expansion space 1036. The expansion space 1036 may increase in volume in comparison to previous embodiments. In this case, airborne noise having lower frequencies may be reduced.

Figure 9:
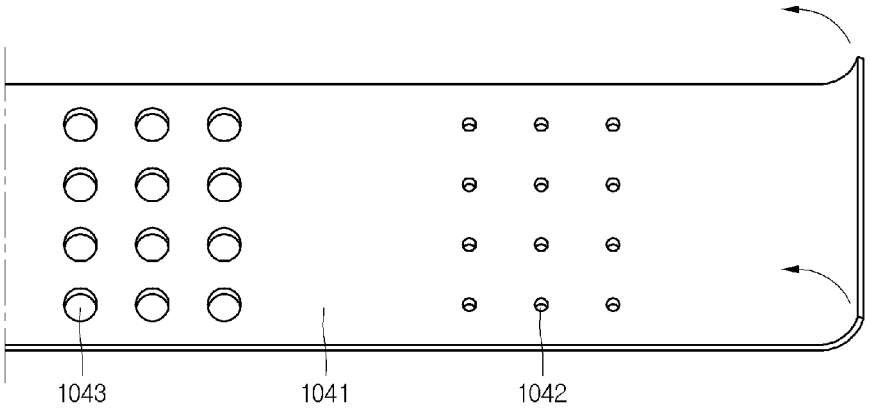
FIG. 9 is a view illustrating an example of a stainless plate to be processed as a shell.

FIG. 9 is a view illustrating an example of a stainless plate to be processed as a shell. Referring to FIG. 9, recesses having sizes different from each other may be provided spaced apart at a predetermined distance, and a stainless plate 1041 may be rolled in an arrow direction to form multilayer plate 1018. The recesses may include a first recess 1042 having a relatively small size and defined at an innermost position, and a second recess 1043 defined immediately outside the first recess 1042 to provide resonator 1015 together with the first recess 1042. The first and second recesses 1041 and 1042 may be processed at adequate positions according to a size of container 1017 and a thickness of the multilayer plate 1018. As the plate 1041 may be rolled and fixed, the recesses 1042 and 1043 may be aligned with each other to provide the resonator 1015.

Figure 10:
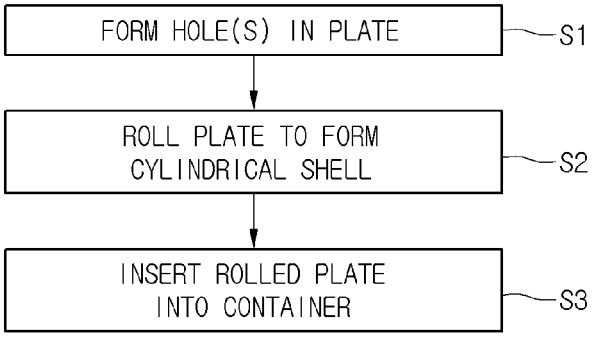
FIG. 10 is a flowchart of a method of manufacturing a linear compressor according to an embodiment.

FIG. 10 is a flowchart of a method of manufacturing a linear compressor according to an embodiment. Referring to FIG. 10, one or more holes may be formed in a plate formed of a stainless material, in step S1. The one or more holes may be defined at positions in the plate as it is processed as a multilayer plate, and then, the one or more holes may be stacked. For example, a first hole, and a second hole stacked on the first hole may be spaced apart from each other by a length in a circumferential direction thereof. Sizes and relative arrangements of the holes may be provided to have an optimum airborne noise reduction effect in a state in which noise characteristics of the linear compressor are considered. A total length in a direction in which the plate is rolled may be adequately provided to maximize the vibration noise reduction effect and minimize weight and manufacturing costs. That is, in a case in which the vibration noise reduction effect has to increase due to high drive frequency, the plate may increase in length to provide at least five plates forming the multilayer plate.

Thereafter, the plate may be rolled into a cylindrical shape to manufacture a multilayer plate, in step S2, and then a container and the multilayer plate may be coupled to each other to manufacture a shell, in step S3. Respective portions of the shell may be fixed by, for example, welding, and thus, firmly manufactured.

Due to the above-described manufacturing method, a shell of a linear compressor may be cheaply, effectively, and stably manufactured.

Embodiments may further include another embodiment in addition to the previous embodiments. For example, a resonator may be changed in configuration.

Figure 11:
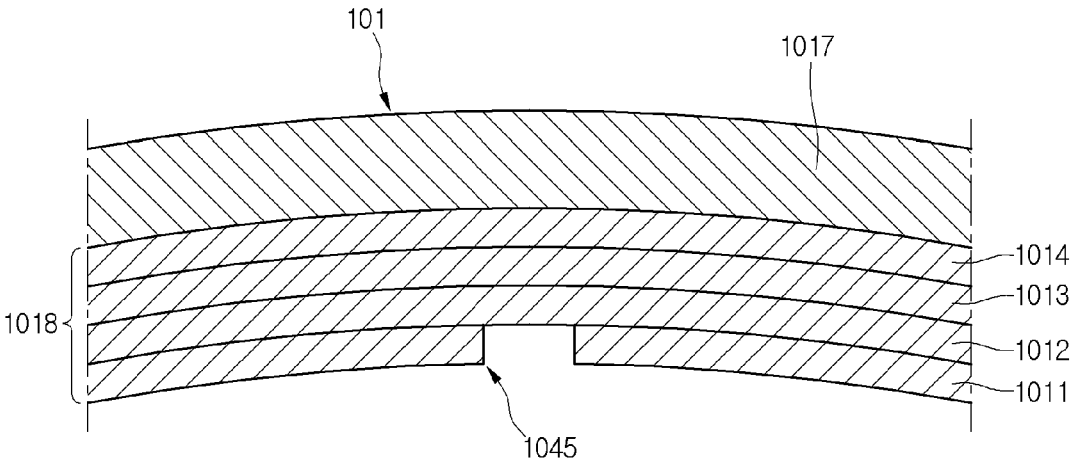
FIG. 11 is a partial cross-sectional view of a shell according to another embodiment.

FIG. 11 is a partial cross-sectional view of a shell according to another embodiment. Referring to FIG. 11, resonator 1045 may be provided in only first layer plate 1011 disposed at an innermost position of multilayer plate 1018.

As another example, a container may not be provided, and only a multilayer plate may be provided.

According to embodiments, noise generation may be significantly reduced in a cylindrical linear compressor having a small size. In particular, a linear compressor that operates at a high frequency of about 100 Hz or more may be reduced in noise generation to manufacture premium products. Airborne noise as well as vibration noise may be reduced to improve a user's inconvenience in various aspects.

According to embodiments, a linear compressor may be realized at a low price and with high quality to provide high price competitiveness. According to embodiments, noise generation may be significantly reduced in a cylindrical linear compressor capable of reducing a volume of a machine room of electronic equipment, such as a refrigerator.

According to embodiments, a linear compressor that operates at a high frequency of about 100 Hz or more may be reduced in noise generation to manufacture premium products. According to embodiments, airborne noise as well as vibration noise may be reduced to improve a user's inconvenience in various aspects. According to embodiments, a noise reduction structure for a linear compressor may be realized at a low price.

Embodiments disclosed herein provide a shell for a linear compressor, at least a portion of which has a multilayer plate structure in which at least two plates may be stacked in a direction substantially perpendicular to an axis of a piston so as to accommodate a cylinder, the piston reciprocated within the cylinder, and a motor assembly directly connected to the piston to provide a drive force to the piston. A resonator may be disposed in at least a portion of an inner surface of the shell.

Embodiments disclosed herein provide a linear compressor that may include a shell; a cylinder disposed within the shell to define a compression space for a refrigerant; a piston reciprocated within the cylinder, the piston comprising a suction valve; and a discharge valve disposed at a side of the cylinder to selectively discharge the refrigerant compressed in the compression space. The shell may include a container, and a multilayer plate, in which at least two plates may be stacked on at least a portion thereof in a radial direction of the shell, the multilayer plate being disposed within the container. A resonator may be disposed in at least a portion of an inner surface of the shell.

Embodiments disclosed herein provide a method of manufacturing a shell for a linear compressor, the cylindrical shell accommodating a cylinder, a piston reciprocated within the cylinder, and a motor assembly directly connected to the piston to provide a drive force to the piston. The method may include making a hole in a plate; and rolling the plate to manufacture a multilayer plate so as to couple a container to the multilayer plate in a state in which the multilayer plate is disposed inside the container.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylindrical shell providing an outer section of the linear compressor;

a permanent magnet being movable by a stator provided in the cylindrical shell;

a cylinder provided within the cylindrical shell so as to define a compression space;

a piston being movable horizontally along with the cylinder by the permanent magnet;

a multilayer plate provided on an inner surface of the cylindrical shell, the multilayer plate including at least two plates stacked in a direction substantially perpendicular to an axis of the piston so as to accommodate the cylinder and the piston; and at least one resonator having an expansion space provided in at least a portion of the inner surface of the multilayer plate such that sound may enter into the expansion space to reduce noise of the linear compressor, wherein the at least one resonator includes at least one recess that communicates with an inner space of the cylindrical shell, wherein the at least one recess includes a first recess defined in a first layer plate provided at an innermost position of the multilayer plate and a second recess defined in a second layer plate provided outside of the first layer plate with respect to the inner space and wherein the first recess has a cross-sectional area less than a cross-sectional area of the second recess.

2. The linear compressor according to claim 1, wherein the at least one resonator is provided in or at least a suction-side of the linear compressor.

3. The linear compressor according to claim 1, wherein the at least one resonator includes at least two kinds of resonators having shapes different from each other.

4. The linear compressor according to claim 1, wherein the multilayer plate is provided at least a discharge-side of the linear compressor.

5. The linear compressor according to claim 1, wherein the multilayer plate further includes a container.

6. The linear compressor according to claim 1, wherein the multilayer plate extends along an entire circumference of the cylindrical shell.

7. The linear compressor according to claim 1, wherein the cylindrical shell is formed of a flat plate having a plurality of holes formed therein and then rolled into a cylindrical form.

8. The linear compressor according to claim 1, wherein the multilayer plate includes the first layer plate, the second layer plate, a third layer plate, and a fourth layer plate.

* * * * *